US008727498B2

(12) United States Patent
Satoh

(10) Patent No.: US 8,727,498 B2
(45) Date of Patent: May 20, 2014

(54) DRIVE CIRCUIT FOR INKJET RECORDING HEAD, AND INKJET RECORDING DEVICE

(75) Inventor: Kaoru Satoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/540,709

(22) Filed: Jul. 3, 2012

(65) Prior Publication Data

US 2013/0027474 A1 Jan. 31, 2013

(30) Foreign Application Priority Data

Jul. 27, 2011 (JP) ..... 2011-164581
Apr. 19, 2012 (JP) ..... 2012-095730

(51) Int. Cl.
*B41J 2/30* (2006.01)

(52) U.S. Cl.
USPC ..... 347/50

(58) Field of Classification Search
USPC ..... 347/50
See application file for complete search history.

(56) References Cited

U.S. PATENT DOCUMENTS 4,126,867 A * 11/1978 Stevenson, Jr. ..... 347/10
5,969,744 A * 10/1999 Sakashita et al. ..... 347/237
6,504,701 B1 * 1/2003 Takamura et al. ..... 361/225
2009/0315952 A1 * 12/2009 Hatsui et al. ..... 347/63

FOREIGN PATENT DOCUMENTS

JP 2002-187270 A 7/2002
JP 2003-170588 A 6/2003
JP 2010-188623 A 9/2010

* cited by examiner

*Primary Examiner* — Stephen Meier
*Assistant Examiner* — Alexander D Shenderov
(74) *Attorney, Agent, or Firm* — Harness, Dickey & Pierce, P.L.C.

(57) ABSTRACT

A drive circuit for an inkjet recording head includes a plurality of electrically capacitive actuator elements, a drive signal source, a plurality of switching elements, and a plurality of resistances. The actuator elements are provided for a plurality of nozzles, and drive the nozzles to eject ink therefrom. The drive signal source outputs a drive signal for driving the actuator elements. The switching elements are connected to the respective actuator elements to separately drive the actuator elements, and selectively apply the output drive signal to the actuator elements. The resistances are provided for the respective actuator elements, and are connected to low potential sides of the actuator elements. Each of the resistances has a resistance value adjusted in accordance with the length of a wire between the corresponding one of the actuator elements and the drive signal source.

6 Claims, 7 Drawing Sheets

| CHANNEL | RESISTANCE VALUE |
|---|---|
| 001 | xxx |
| 002 | xxx |
| 003 | xxx |
| 004 | xxx |
| 005 | xxx |
| 006 | xxx |
| . . . | |

DRIVE CIRCUIT FOR INKJET RECORDING HEAD, AND INKJET RECORDING DEVICE

CROSS-REFERENCE TO RELATED APPLICATIONS

This patent application is based on and claims priority pursuant to 35 U.S.C. §119 to Japanese Patent Application No. 2011-164581, filed on Jul. 27, 2011 and Japanese Patent Application No. 2012-095730, filed on Apr. 19, 2012, in the Japan Patent Office, the entire disclosures of which are hereby incorporated by reference herein.

FIELD OF THE INVENTION

The present invention relates to a drive circuit for an inkjet recording head and an inkjet recording device, and more particularly to control of variations in ink amounts ejected from a plurality of channels mounted on an inkjet recording head.

BACKGROUND OF THE INVENTION

With a tendency in recent years to promote digitization of information, image processing apparatuses, such as printers and facsimile machines used to output digitized information and scanners used to digitize documents, have become indispensable. In many cases, such image processing apparatuses are provided with capabilities such as an imaging function, an image forming function, and a communication function and configured as a multifunction machine usable as a printer, a facsimile machine, a scanner, and a copier.

Among such image processing apparatuses, one type of printer used to output digitized information uses an inkjet method (hereinafter referred to as an inkjet printer). In the inkjet printer, a recording head ejects ink onto a sheet serving as a recording medium, and thereby an image is formed.

Control of the ink ejection from the recording head is conducted by various means, for example, by a device using a piezoelectric element, a device which heats the ink to generate air bubbles and eject the ink with the resultant pressure, or a device using electrostatic force. The recording head using such an ejection control device is capable of realizing a high-density multi-nozzle structure with relative ease and thus forming a high-definition image on the sheet.

To form a high-quality image by using such a multi-nozzle recording head, it is desirable to uniformly control the ink amounts ejected from the respective nozzles. However, an increase in the number of nozzles, i.e., channels, requires variations in the lengths of the individual wiring used for driving the respective channels. As a result, the multi-nozzle, i.e., multi-channel recording head also experiences variations in drive signal waveform among the channels. The differences in drive signal waveform appear as differences in ejected ink amount. Consequently, therefore, the image quality is degraded.

To address the above issue, it is possible to set different ON resistances for switching elements which control signal application to driving elements for driving the respective channels, and vary the wiring resistance between the driving element and the switching element by channel, thus offsetting changes in impedance due to the variations in the length of the wiring and minimizing the differences in drive signal waveform.

Alternatively, it is possible to provide an impedance changing device on each of multiple signal supply lines for supplying signals to the switching elements on the respective channels, to thereby obtain an effect similar to the above-described effect. Still another method is to provide a charging device which sets, for each of the driving elements on the respective channels, the state of charge of the driving element, to thereby obtain an effect similar to the above-described effect.

In the first method, the wiring resistance between the switching element and the driving element is adjusted for each of the channels. Unlike a case where components to be connected are selected, adjusting the wiring resistance involves, for example, adjusting the length of the wires and adjusting the components of the material forming the wiring line. Therefore, the method complicates both design and production, and causes an increase in cost.

Further, in the second and third methods, an extra device such as an impedance changing device and a charging device must be provided, causing an increase in device size and cost.

SUMMARY OF THE INVENTION

The present invention describes a novel drive circuit for an inkjet recording head. In one example, a novel drive circuit for an inkjet recording head includes a plurality of electrically capacitive actuator elements, a drive signal source, a plurality of switching elements, and a plurality of resistances. The actuator elements are provided for a plurality of nozzles, and are configured to drive the nozzles to eject ink therefrom. The drive signal source is configured to output a drive signal for driving the actuator elements. The switching elements are connected to the respective actuator elements to separately drive the actuator elements, and are configured to selectively apply the output drive signal to the actuator elements. The resistances are provided for the respective actuator elements, and are connected to low potential sides of the actuator elements. Each of the resistances has a resistance value adjusted in accordance with the length of a wiring line between the corresponding one of the actuator elements and the drive signal source.

The above-described drive circuit for an inkjet recording head may further include a recording unit configured to store setting information for setting the resistance values of the resistances. The resistances may be variable resistances, and the resistance values thereof may be set in accordance with the setting information stored in the recording unit to cause the resistance value of each of the resistances to be adjusted in accordance with the length of the wiring line between the corresponding one of the actuator elements and the drive signal source.

Each of the switching elements may include an ON resistance having a resistance value adjusted in accordance with the length of a wiring line length between the corresponding one of the actuator elements and the drive signal source.

Each of the switching elements may include a complementary metal oxide semiconductor (CMOS) analog switch.

The present invention further describes a novel inkjet recording device. In one example, a novel inkjet recording device includes the above-described drive circuit for an inkjet recording head.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF THE INVENTION

Figure 1A:
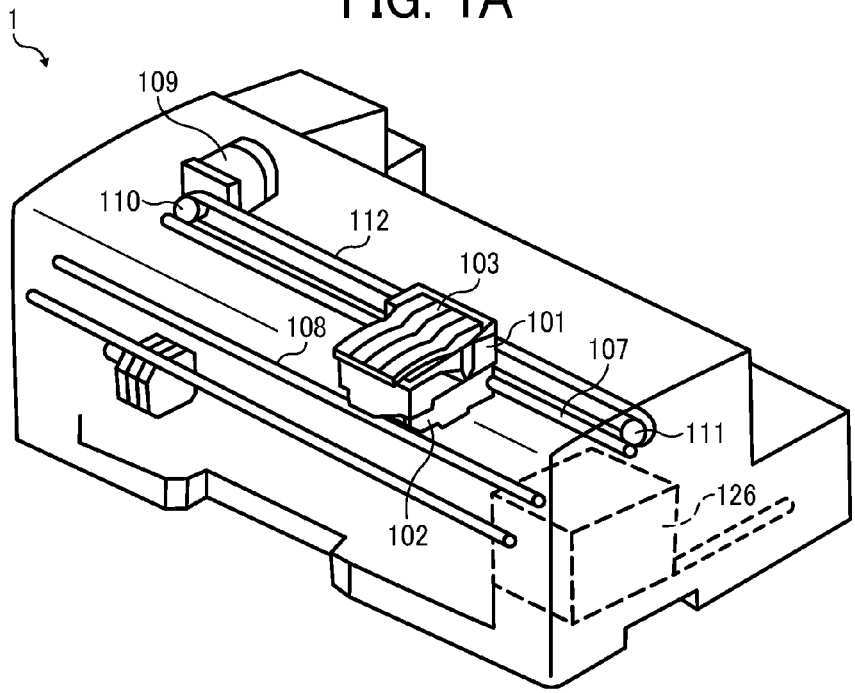
FIGS. 1A and 1B are diagrams illustrating an overall configuration of an inkjet printer according to an embodiment of the present invention.

In describing the embodiments illustrated in the drawings, specific terminology is adopted for the purpose of clarity. However, the disclosure of the present invention is not intended to be limited to the specific terminology so used, and it is to be understood that substitutions for each specific element can include any technical equivalents that operate in a similar manner.

Figure 1B:
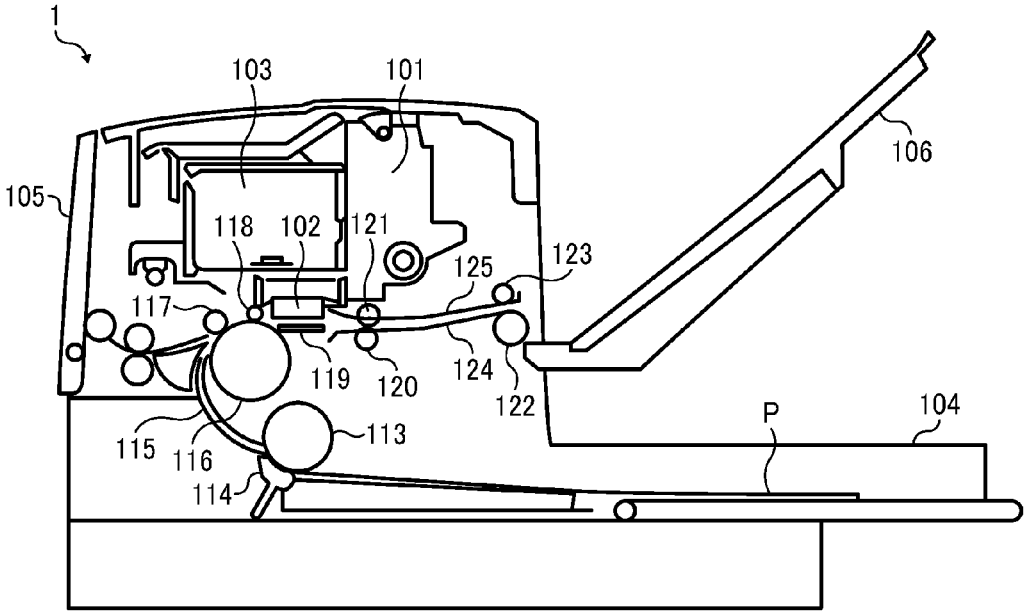

Referring now to the drawings, wherein like reference numerals designate identical or corresponding parts throughout the several views, and particularly to FIGS. 1A to 9, an embodiment of the present invention will be described. In the present embodiment, an inkjet printer including a multi-channel inkjet recording head will be described as an example of an inkjet recording device. FIGS. 1A and 1B are diagrams schematically illustrating an overall configuration of an inkjet printer 1 according to the present embodiment. FIG. 1A is a perspective view of the inkjet printer 1, and FIG. 1B is a perspective side view of the inkjet printer 1.

As illustrated in FIGS. 1A and 1B, the inkjet printer 1 according to the present embodiment includes a printing mechanism unit inside the body thereof. The printing mechanism unit includes a carriage 101 movable in a main scanning direction, inkjet heads 102 mounted on the carriage 101, and ink cartridges 103 for supplying inks to the inkjet heads 102. A sheet feed cassette (or tray) 104, which is capable of carrying a plurality of sheets (i.e., recording media) P loaded thereon from the front side, is attachable to and detachable from a lower portion of the body of the inkjet printer 1. Further, a manual feed tray 105 for manually feeding the sheets P is openable relative to the body of the inkjet printer 1. The inkjet printer 1 receives a sheet P fed from the sheet feed cassette 104 or the manual feed tray 105, causes the above-described printing mechanism unit to record a necessary image on the sheet P, and then discharges the sheet P to a sheet discharge tray 106 attached to the front side of the body of the inkjet printer 1.

In the printing mechanism unit, a main guide rod 107 and a sub-guide rod 108, which are guide members extending between and supported by not-illustrated left and right side plates, hold the carriage 101 to be slidable in the main scanning direction perpendicular to the drawing plane of FIG. 1B. The inkjet heads 102 mounted on the carriage 101 respectively eject ink droplets of yellow (Y), cyan (C), magenta (M), and black (Bk) colors. A plurality of ink ejection ports for ejecting ink of the respective colors are arranged in a direction perpendicular to the main scanning direction, and face downward.

The ink cartridges 103 for supplying the inks of the respective colors to the inkjet heads 102 are replaceably installed in the carriage 101. Further, each of the ink cartridges 103 has an upper portion including air ports communicating with the atmosphere, a lower portion including supply ports for supplying the ink to the inkjet head 102, and an interior including a porous member filled with the ink. With capillary force of the porous member, the ink to be supplied to the inkjet head 102 is maintained at slight negative pressure. Although the present embodiment illustrates an example in which the inkjet heads 102 are provided for the respective colors, alternatively a single inkjet head may be provided which includes nozzles for ejecting the inks of the respective colors.

A rear portion of the carriage 101 on the downstream side in the sheet feeding direction is slidably attached to the main guide rod 107, and a front portion of the carriage 101 on the upstream side in the sheet feeding direction is slidably attached to the sub-guide rod 108. To cause the carriage 101 to move and scan in the main scanning direction, a timing belt 112 is stretched between a drive pulley 110 driven to rotate by a main scanning motor 109 and a driven pulley 111. The timing belt 112 and the carriage 101 are fixed together, and the carriage 101 is driven to move from side to side in accordance with forward and reverse rotations of the main scanning motor 109.

Meanwhile, to feed the sheet P set in the sheet feed cassette 104 toward a position under the inkjet heads 102, the inkjet printer 1 includes a sheet feed roller 113 and a friction pad 114 for separating and feeding the sheet P from the sheet feed cassette 104, a guide member 115 for guiding the sheet P, a feed roller 116 for reversing and feeding the fed sheet P, a feed roller 117 pressed against the outer circumferential surface of the feed roller 116, and a leading end roller 118 for defining a feed angle of the sheet P fed by the feed roller 116. The feed roller 116 is driven to rotate by a not-illustrated sub-scanning motor via a not-illustrated gear train.

The inkjet printer 1 further includes a print receiving member 119 serving as a sheet guide member for guiding the sheet P fed by the feed roller 116 under the inkjet heads 102 in accordance with the range of movement of the carriage 101 in the main scanning direction. On the downstream side of the print receiving member 119 in the sheet feeding direction, a feed roller 120 and a spur 121 are provided which are driven to rotate to feed the sheet P in a sheet discharging direction. The inkjet printer 1 further includes a sheet discharge roller 122 and a spur 123 for feeding the sheet P to the sheet discharge tray 106 and guide members 124 and 125 forming a sheet discharge path.

In the recording of an image onto the sheet P, a not-illustrated controller of the inkjet printer 1 drives the inkjet heads 102 in accordance with an image signal while moving the carriage 101. Thereby, the inks are ejected onto the sheet P at rest to record one scanning line of data. The sheet P is then fed by a predetermined distance, and thereafter the recording of the next line is performed. Upon receipt of a recording end signal or a signal indicating the arrival of the trailing end of the sheet P to a recording area, the controller completes the recording operation, and discharges the sheet P.

The inkjet printer 1 further includes, off to the side of the moving direction of the carriage 101 in FIG. 1A and outside the recording area, a maintenance device 126 for maintaining the inkjet heads 102 and preventing ejection failure. The maintenance device 126 includes a capping device, a suction device, and a cleaning device. In a print standby state, the carriage 101 is moved to the maintenance device 126, and the inkjet heads 102 are capped by the capping device. Thereby, the ejection ports are kept in a moist state, and an ejection failure due to dried ink clogging the ports of the nozzles is prevented.

Further, during the recording, for example, the inkjet heads 102 eject to the maintenance device 126 inks unrelated to the recording to keep the ink viscosity uniform in all of the ejection ports and maintain stable, reliable ejection performance. Specifically, if an ejection failure occurs, for example, the capping device seals the ejection ports of the nozzles in the inkjet heads 102, and the suction device sucks the inks, air bubbles, and so forth from the ejection ports through tubes. Further, the cleaning device removes the inks, dusts, and so forth adhering to ejection port surfaces of the inkjet heads 102. Thereby, the inkjet heads 102 recover from the ejection failure. The sucked inks are discharged to a not-illustrated waste ink container installed in a lower portion of the body of the inkjet printer 1, and are absorbed and held by an ink absorbing member provided inside the waste ink container.

In the thus-configured inkjet printer 1, each of the inkjet heads 102 is provided with a drive circuit 200 including driving elements for driving the respective nozzles to eject the ink. The configuration of the drive circuit 200 for uniformly ejecting the ink from the plurality of nozzles of the inkjet head 102 characterizes the present embodiment.

Figure 2:
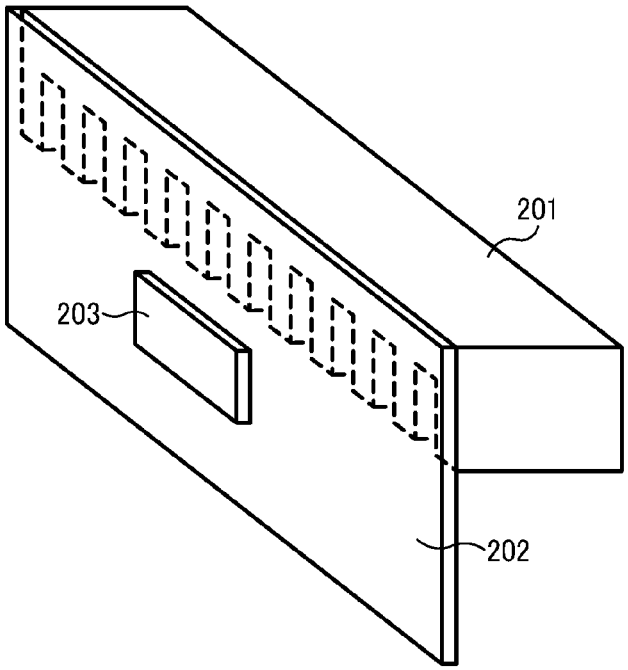
FIG. 2 is a diagram illustrating a drive unit of an inkjet recording head according to an embodiment of the present invention.

FIG. 2 is a perspective view schematically illustrating a configuration of a drive unit of the inkjet head 102 according to the present embodiment. As illustrated in FIG. 2, the drive unit of the inkjet head 102 according to the present embodiment includes a piezoelectric element 201, a wiring board 202, and an integrated circuit 203. The piezoelectric element 201 includes driving elements serving as actuator elements for driving the plurality of nozzles of the inkjet head 102. The wiring board 202 supplies signals to each of the driving elements included in the piezoelectric element 201. The integrated circuit 203 includes switching elements for selectively supplying the signals to the driving elements via the wiring board 202. The configuration of the drive circuit 200 according to the present embodiment includes the piezoelectric element 201, the wiring board 202, and the integrated circuit 203.

Figure 3:
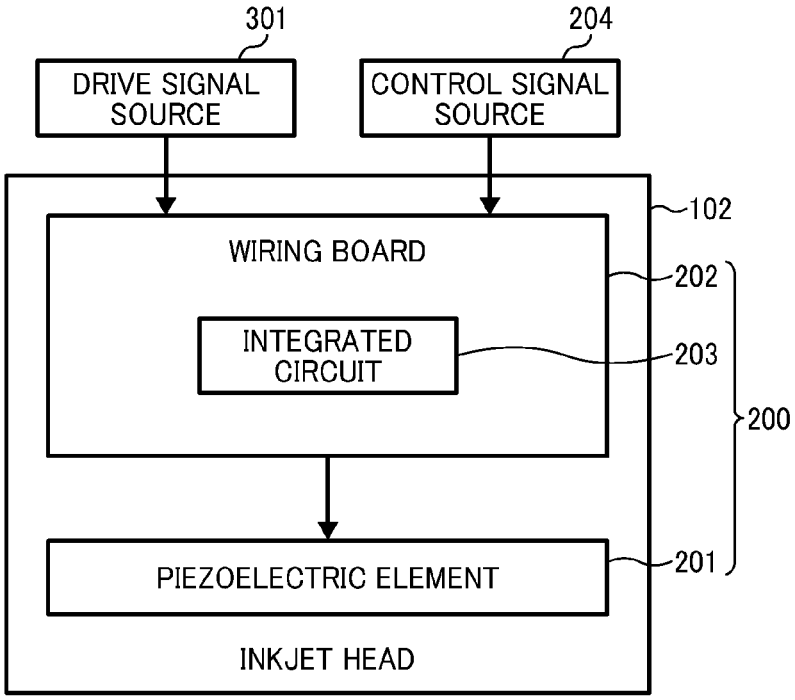
FIG. 3 is a block diagram illustrating a drive and control configuration of the inkjet recording head according to the embodiment of the present invention.

FIG. 3 is a block diagram illustrating a drive and control configuration of the inkjet head 102 according to the present embodiment. As illustrated in FIG. 3, in addition to the piezoelectric element 201, the wiring board 202, and the integrated circuit 203 mounted on the wiring board 202, which are included in the inkjet head 102, the drive and control configuration of the inkjet head 102 according to the present embodiment also includes a drive signal source 301 which outputs a drive signal for driving the piezoelectric element 201 and a control signal source 204 which outputs a control signal for causing the integrated circuit 203 to selectively supply the drive signal to the piezoelectric element 201. The control signal source 204 outputs the control signal for selectively supplying the drive signal to the piezoelectric element 201 by using control signals such as serial data signals, mask signals, and latch signals.

Figure 4:
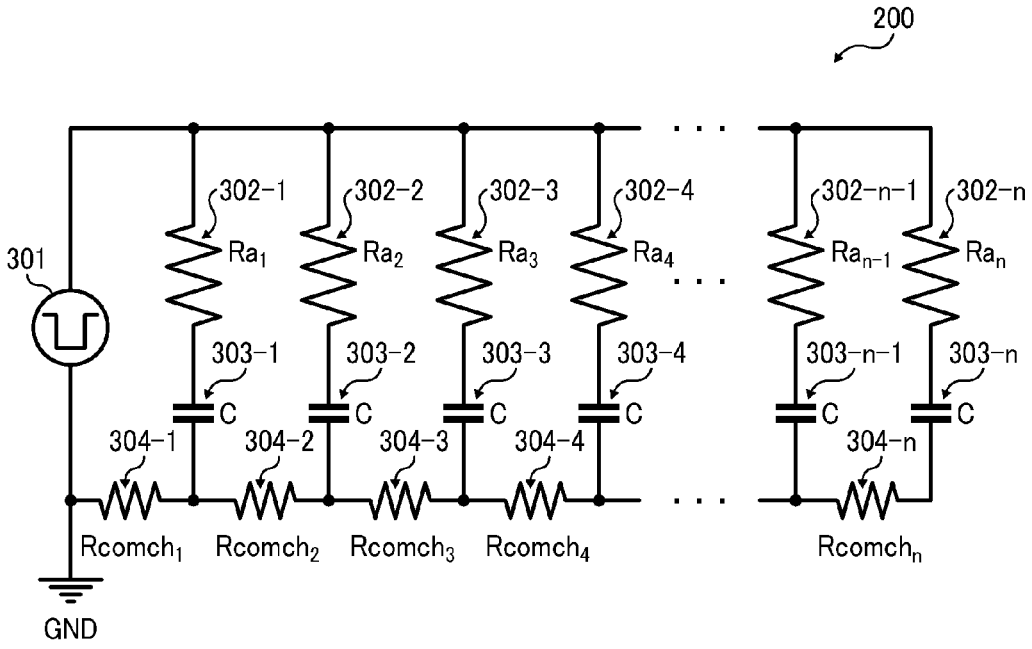
FIG. 4 is a circuit diagram illustrating a drive circuit for the inkjet recording head according to the embodiment of the present invention.

FIG. 4 is a circuit diagram illustrating the above-described drive circuit 200 including the piezoelectric element 201, the wiring board 202, and the integrated circuit 203. As illustrated in FIG. 4, the drive circuit 200 according to the present embodiment includes the drive signal source 301 which outputs the drive signal for driving the piezoelectric element 201, ON resistances 302-1 to **302-*n* (hereinafter collectively referred to as ON resistances 302) of the switching elements for switching the signal application state of the driving elements, element capacitances 303-1 to 303-*n* (hereinafter collectively referred to as element capacitances 303) of the driving elements, and return resistances 304-1 to 304-*n* (hereinafter collectively referred to as return resistances 304**) provided on the low potential sides of the driving elements on paths for applying a voltage to the driving elements.

As illustrated in FIG. 4, to separately drive the plurality of driving elements, the plurality of ON resistances 302 are connected to the respective element capacitances 303 serving as the driving elements. The ON resistances 302 are the resistances of analog switches serving as the switching elements provided in the drive unit of the inkjet recording head 102. If the resistance value of the ON resistance 302 is increased, the waveform is rounded. Conversely, if the resistance value of the ON resistance 302 is reduced, a signal having a waveform close to the waveform of the signal output from the drive signal source 301 is applied to the piezoelectric element 201. The ON resistances 302 have resistance values $Ra_1$ to $Ra_n$ on the respective channels.

The switching between ON and OFF of the analog switches corresponding to the respective ON resistances 302 is controlled by the control signal input from the control signal source 204 described with reference to FIG. 3. That is, the control signal source 204 outputs the control signal to turn on the analog switch corresponding to the ON resistance 302 on a channel intended to eject the ink, and to turn off the analog switch corresponding to the ON resistance 302 on a channel not intended to eject the ink.

The return resistances 304 are provided for the respective element capacitances 303 serving as the driving elements, and are connected to a common electrode portion of all of the channels on the low potential sides of the element capacitances 303. Similarly to the ON resistance 302, if the resistance value of the return resistance 304 is increased, the waveform is rounded. Conversely, if the resistance value of the return resistance 304 is reduced, a signal having a waveform close to the waveform of the signal output from the drive signal source 301 is applied to the piezoelectric element 201. The driving elements serving as the actuator elements included in the piezoelectric element 201 are electrically capacitive. When the element capacitances 303 are charged, the nozzles of the respective channels are driven. The return resistances 304 have resistance values $Rcomch_1$ to $Rcomch_n$ on the respective channels. Further, the element capacitances 303 according to the present embodiment have the same capacitance C on all of the channels.

In the configuration of the respective components illustrated in FIG. 4, the drive signal source 301, the ON resistances 302, and the return resistances 304 are included in the integrated circuit 203, and the element capacitances 303 are included in the piezoelectric element 201. The piezoelectric element 201, the wiring board 202, and the integrated circuit 203 are configured as illustrated in FIG. 2, for example. Therefore, the total lengths of wires extending from the integrated circuit 203 to the driving elements on the respective channels included in the piezoelectric element 201 via the wiring board 202 are different for each channel. In the drive circuit 200 as illustrated in FIG. 3, therefore, the lengths of wires forming signal paths from the drive signal source 301 to the element capacitances 303 via the ON resistances 302 are different for each channel.

The differences in length of the wires produce differences in impedance of the signal paths among the channels. If all of the channels are driven by a single drive signal source, therefore, the signals applied to the respective channels are different in intensity and timing. As a result, there arise variations in control of the nozzles included in the inkjet head 102, and the variations affect the image quality of the image formed by the ejected ink.

To address the above-described issue, in the drive circuit 200 according to the present embodiment, at least the resistance value of each of the return resistances 304 is adjusted in accordance with the length of the wires from the drive signal source 301 to the element capacitance 303 on the corresponding channel. Thereby, the impedances of the signal paths of the respective channels are adjusted to be substantially equal, and signal variations among the channels are reduced. Thereby, the image quality of the image formed by the ink ejected from the inkjet head 102 is improved.

An impedance $Z_n$ of the signal path of each of the channels is calculated by the following formula (1).

$$Z_n = \sqrt{R_n^2 + \left(\omega L - \frac{1}{\omega C}\right)^2} \tag{1}$$

$$R_n = Ra_n + \sum_{i=1}^{n} Rcomch_i$$

That is, in the impedance of the signal path of each of the channels, only by the resistance corresponding to the channel contributes to the ON resistance 302 affected. By contrast, the cumulative value of the resistance values $Rcomch_1$ to $Rcomch_n$ contributes to the return resistance 304 corresponding to the n-th channel, for example. Herein, as illustrated in formula (1), the respective channels have the same capacitance C of the element capacitances 303 and the same inductance L.

FIG. 4 is a circuit diagram of the drive circuit 200, and does not illustrate actual lengths of the wires. Assuming that the actual lengths of the wires correspond to those of the circuit diagram in FIG. 4, however, if the impedance $Z_n$ of the signal path of each of the channels is set to be substantially the same among the channels, the differences in impedance due to the wiring resistances are offset, and the differences in impedance among the signal paths of the respective channels are reduced or substantially eliminated.

According to the present embodiment, to reduce or substantially eliminate the differences in impedance, the resistance values of the return resistances 304 on the respective channels have the relationship as expressed by the following formula (2).

$$Rcomch_1 > Rcomch_2 > Rcomch_3 > Rcomch_4 > \ldots > Roomch_n \tag{2}$$

Further, in the present embodiment, the resistance values of the ON resistances 302 are also different for each channel, and have the relationship as expressed by the following formula (3).

The resistance value of each of the ON resistances 302 and the return resistances 304 is adjusted in accordance with the length of the wiring line forming the signal path of the $$Ra_1 > Ra_2 > Ra_3 > Ra_4 > \ldots > Ra_n \tag{3}$$

corresponding channel, such that the impedance $Z_n$ of the signal path of each of the channels is substantially equal among all the channels. Thereby, the differences in impedance among the signal paths of the respective channels are reduced or substantially eliminated, as described above.

Figure 5A:
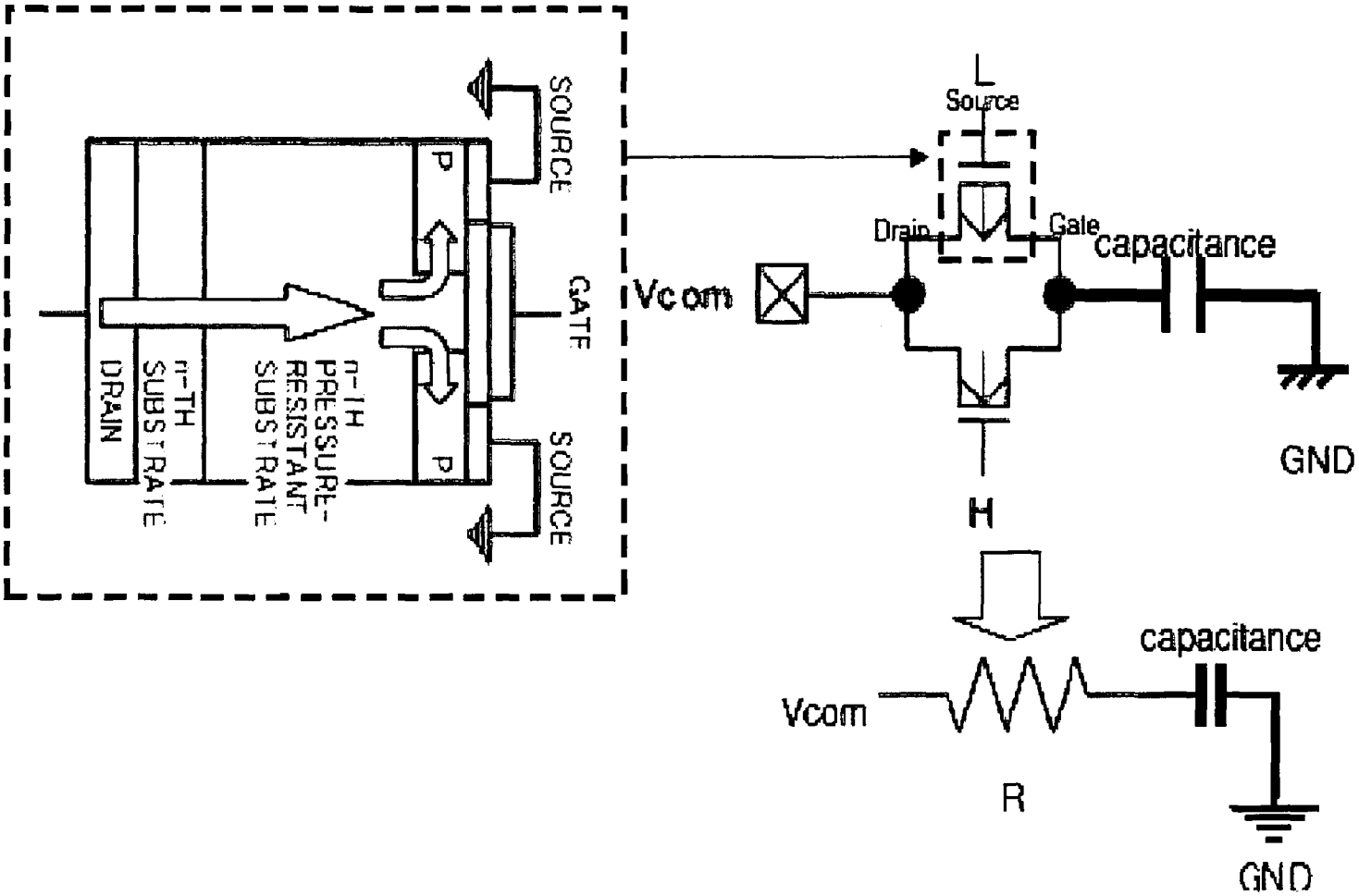
FIGS. 5A and 5B are diagrams illustrating a switching element of the inkjet recording head according to the embodiment of the present invention.
Figure 5B:
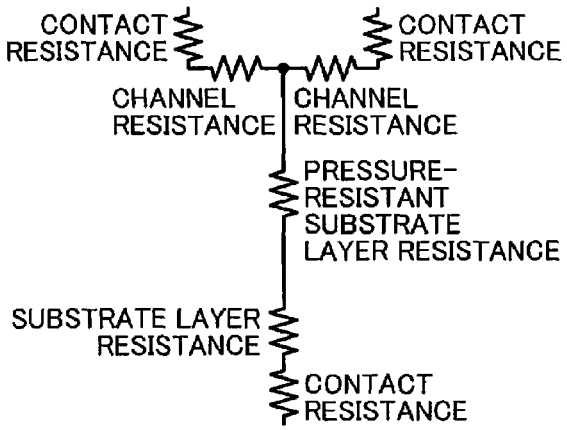

FIGS. 5A and 5B are diagrams illustrating an embodiment of the switching element according to the present embodiment for switching the signal application state of the corresponding driving element, i.e., a circuit element forming the ON resistance 302. As illustrated in FIGS. 5A and 5B, a complementary metal oxide semiconductor (CMOS) analog switch is used as the switching element according to the present embodiment.

With the use of the CMOS analog switch, the driving of the inkjet head 102 is adjusted with relatively accurately reliably. Further, if the respective thicknesses of a pressure-resistant substrate layer and a substrate layer illustrated in FIG. 5A are adjusted in a stepwise manner for each of the channels in accordance with the magnitude relationship expressed by the above formula (3), the magnitude relationship of the ON resistances 302 as in the formula (3) is realized with relative ease.

Figure 6:
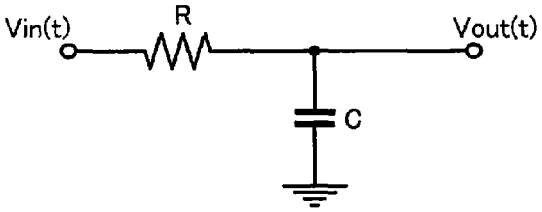
FIG. 6 is a circuit diagram illustrating a simplified model of each of channels of the inkjet recording head according to the embodiment of the present invention.

FIG. 6 is a circuit diagram illustrating a simplified model of the amount of signal degradation on each of the channels in the drive circuit 200 for the inkjet head 102. In FIG. 6, Vin(t) represents the time-dependent voltage value of the voltage output by the drive signal source 301, and Vout(t) represents the time-dependent voltage value of the voltage applied to the element capacitance 303 after signal degradation by the ON resistance 302 and the return resistance 304 on each of the channels.

In the simplified model as illustrated in FIG. 6, the voltage value Vout(t) is calculated by the following formula (4).

$$Vout(t) = Vin(t)\left\{\exp\left(\frac{-t}{\tau'}\right)\right\} \tag{4}$$

$$\tau' = CR$$

In FIG. 6 and formula (4), R represents the resistance value of a combined resistance calculated for each of the channels by the formula (1). As apparent from formula (1), the resistance value of each of the channels is increased in accordance with a value n representing the number of channels. It is therefore understood that the voltage value Vout(t) of the voltage applied to the element capacitance 303 on each of the channels is reduced in accordance with the value n.

Figure 7:
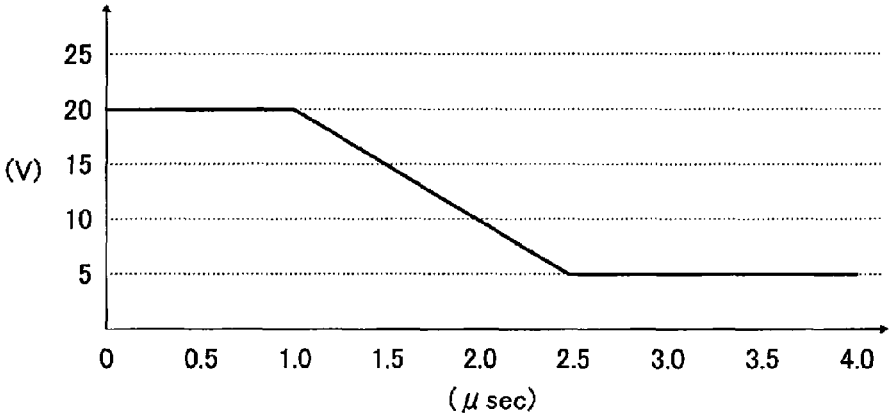
FIG. 7 is a graph illustrating a drive waveform of the inkjet recording head according to the embodiment of the present invention.

The amount of signal degradation in a case using the drive circuit 200 according to the present embodiment will now be described with reference to an example, using a case where a linearly changing signal as illustrated in FIG. 7 is output by the drive signal source 301. In the example of FIG. 7, the signal intensity is reduced from approximately 20 V to approximately 5 V during a period of approximately 1.5 μsec, extending from approximately 1.0 μsec to approximately 2.5 μsec from a start time.

Figure 8:
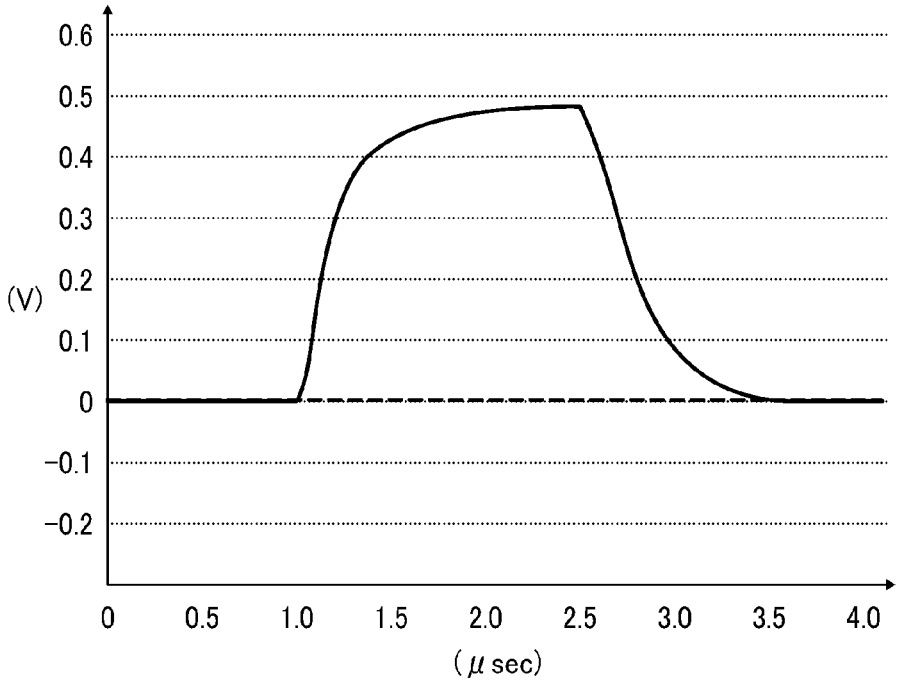
FIG. 8 is graphs each illustrating the difference in drive waveform between channels of the inkjet recording head according to the embodiment of the present invention.
Figure 9:
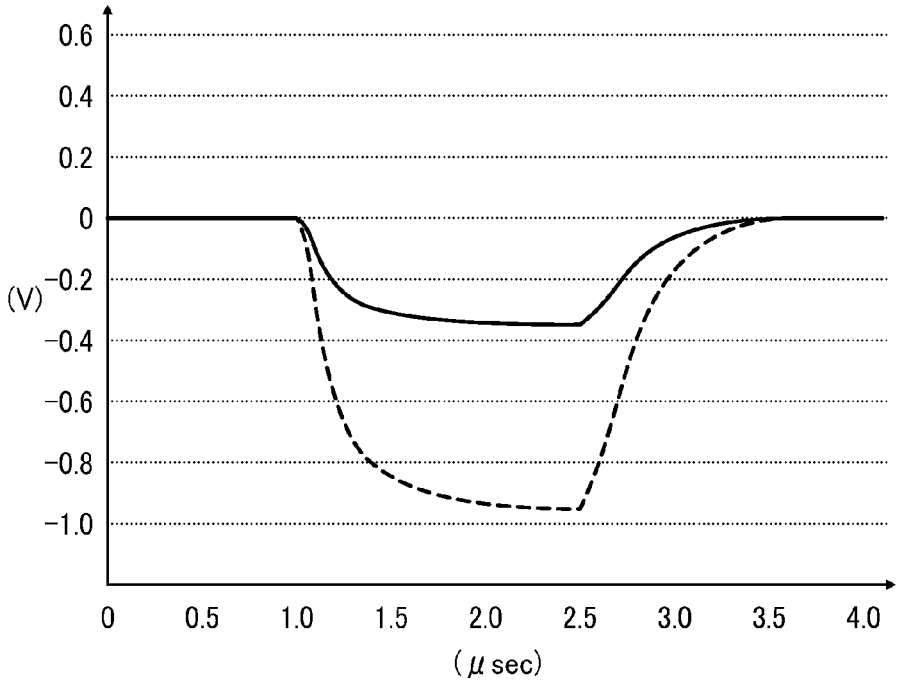
FIG. 9 is graphs each illustrating the difference in drive waveform between channels of the inkjet recording head according to the embodiment of the present invention.

FIGS. 8 and 9 are graphs each illustrating the difference in signal intensity between the first channel and the hundredth channel in a case where the value n representing the number of channels is 100 and the signal as illustrated in FIG. 7 is output from the drive signal source 301. To illustrate the degree of reduction in signal intensity according to the increase in the number of channels, FIGS. 8 and 9 illustrate, as a graph, the value obtained by subtracting the signal intensity of the first channel from the signal intensity of the hundredth channel.

FIG. 8 is a graph each illustrating the difference in signal intensity between the first channel and the hundredth channel obtained by separately driving each of the channels. FIG. 9 is a graph each illustrating the difference in signal intensity between the first channel and the hundredth channel obtained by driving all of the channels. In each of FIGS. 8 and 9, a dashed line indicates the result of a case using a related art drive circuit not according to the present embodiment.

If the channels are separately driven, the resistance value of the ON resistance 302 is lower in the hundredth channel than in the first channel. Therefore, the signal intensity is higher in the hundredth channel than in the first channel, and the difference in signal intensity is expressed as a positive value, as indicated by the solid line in FIG. 8. By contrast, in the related art drive circuit, the resistance value of the ON resistance is the same among the channels. Therefore, the signal intensity is the same between the first channel and the hundredth channel, and the difference in signal intensity is substantially zero, as indicated by the dashed line in FIG. 8.

If all of the channels are driven, the difference in signal intensity reaches a value of approximately 1.0 V in the related art drive circuit, as indicated by the dashed line in FIG. 9. By contrast, in the drive circuit 200 according to the present embodiment, the difference in signal intensity is minimized to less than approximately half the value of the related-art drive circuit, as indicated by the solid line in FIG. 9. This is because the resistance values of the ON resistances 302 and the return resistances 304 are adjusted to be reduced in accordance with the number of channels, i.e., the length of the wires.

That is, due to the differences in length of the wires among the channels, the signal supplied to the ON resistance on each of the channels is degraded in accordance with the length of the corresponding wiring line. Meanwhile, in the drive circuit 200 according to the present embodiment, the resistance values of the ON resistances 302 and the return resistances 304 are adjusted in accordance with the length of the wires to offset the above-described signal degradation according to the length of the wires. Accordingly, the differences in signal intensity of the signals applied to the driving elements on the respective channels are minimized, and errors in ink ejection amount of the channels are minimized.

The graphs of FIGS. 8 and 9 are examples. With further adjustment of the resistance values of the ON resistances 302 and the return resistances 304, it is possible to provide a design which substantially eliminates the difference in signal intensity in the case where all of the channels are driven.

As described above, in the drive circuit 200 for the inkjet head 102 according to the present embodiment, the resistance values of the return resistances 304 are set to be different for each channel such that the respective impedances are adjusted in accordance with the lengths of the wires supplying the signals to the driving elements on the respective channels. Therefore, the differences in signal intensity generated when driving the respective channels are minimized, and the errors in ink ejection amount are reduced.

In the present embodiment, there is no need to add a special device to the drive circuit 200 or adjust the lengths of the wires between the ON resistances 302 and the element capacitances 303. Therefore, there is no increase in cost due to the addition of an extra device, and no limitation in design or increase in design load due to adjustment of the lengths of the wires. Further, in the present embodiment, it suffices if at least the resistance value of the return resistance 304 provided on the low potential side of the driving element on each of the channels is adjusted for each of the channels in accordance with the length of the wiring line. Therefore, the above-described effect is obtained with a relatively simple configuration.

In the above-described embodiment, a case where the respective resistance values of the return resistances 304 are previously adjusted has been described as an example. However, there is manufacturing tolerance affecting wiring resistance of an integrated circuit. Even if circuits are manufactured on the basis of the same design, therefore, the impedance may be different for each channel. As a result, the previously adjusted resistance values of the return resistances 304 may fail to favorably offset the signal degradation according to the lengths of the wires.

Figures 10, 11:
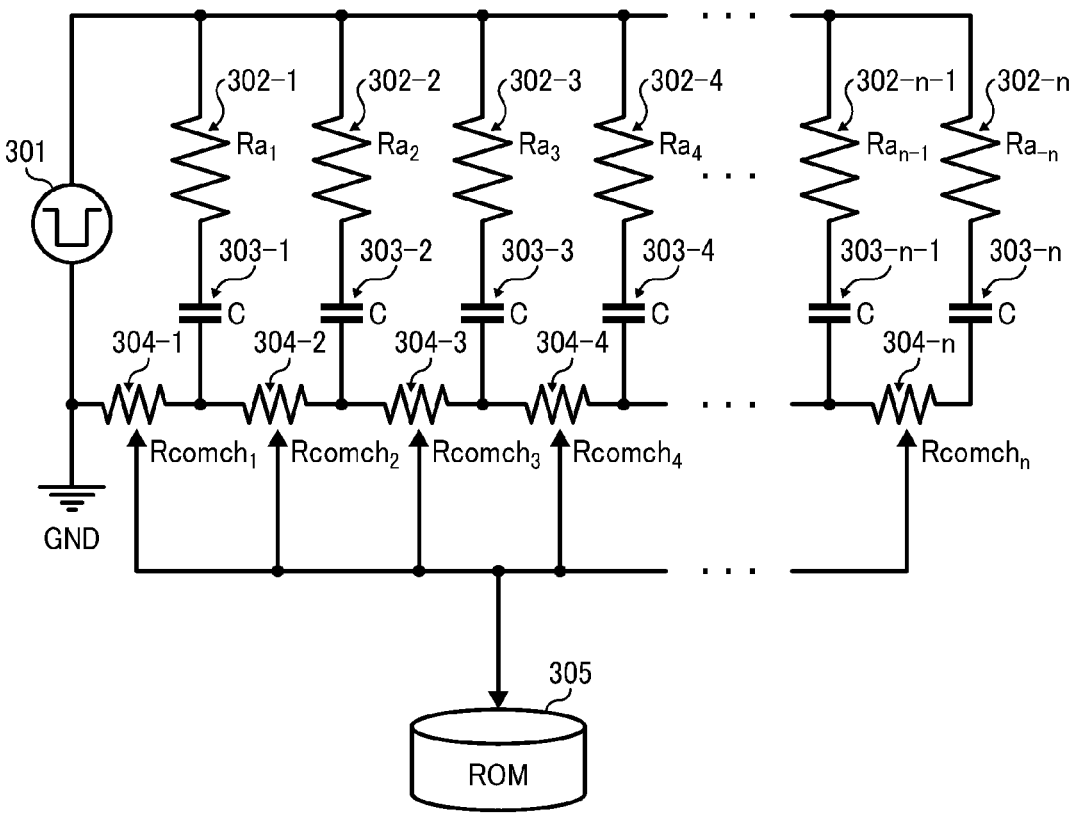
FIG. 10 is a circuit diagram illustrating a drive circuit for an inkjet recording head according to another embodiment of the present invention.
FIG. 11 is a table illustrating an example of setting information for setting resistance values of return resistances according to the another embodiment of the present invention.

In view of this, the drive circuit 200 may be modified such that the return resistances 304 are configured as variable resistances, and that a read-only memory (ROM) 305 is provided which stores setting information for setting the resistance values of the return resistances 304, as illustrated in FIG. 10. That is, after the manufacture of the circuit as illustrated in FIG. 10, the respective impedances of the signal paths of the respective channels are measured. Then, in accordance with the measurement results, the setting information for setting the respective resistance values of the return resistances 304 to offset the signal degradation is stored in the ROM 305. Thereby, the signal degradation including an error due to the manufacturing tolerance of the drive circuit 200 is offset, and the signal intensities of the signals applied to the driving elements on the respective channels are substantially equalized.

FIG. 11 is a table illustrating an example of the setting information for setting the resistance values of the return resistances 304 on the respective channels, which is stored in the ROM 305 of FIG. 10. As illustrated in FIG. 11, identifiers representing the respective channels and the resistance values of the return resistances 304 on the respective channel are stored as associated with each other. Thereby, the above-described effect is obtained.

As well as the case where the ROM 305 stores information directly representing the resistance values of the return resistances 304, as illustrated in FIG. 11, the ROM 305 may store adjustment values for adjusting the resistance values of the return resistances 304. Further, as well as the case where a single ROM 305 stores the setting information, as in FIGS. 10 and 11, the ROM 305 may be provided for each of the return resistances 304.

Further, as well as the case where the resistance values of the return resistances 304 are set on the basis of the information stored in the ROM 305, as described with reference to FIG. 10, the resistance values of the return resistances 304 may be adjusted by the control signal output by the control signal source 204 described with reference to FIG. 3. This configuration allows the resistance values of the return resistances 304 to be adjusted more flexibly, and is capable of handling phenomena such as a change in state and a change over time of a device.

The above-described embodiments are illustrative and do not limit the present invention. Thus, numerous additional modifications and variations are possible in light of the above teachings. For example, elements or features of different illustrative and embodiments herein may be combined with or substituted for each other within the scope of this disclosure and the appended claims. Further, features of components of the embodiments, such as number, position, and shape, are not limited to those of the disclosed embodiments and thus may be set as preferred. It is therefore to be understood that, within the scope of the appended claims, the disclosure of the present invention may be practiced otherwise than as specifically described herein.

What is claimed is:

1. A drive circuit for an inkjet recording head comprising:

a plurality of electrically capacitive actuator elements provided for a plurality of nozzles, and configured to drive the nozzles to eject ink therefrom;

a drive signal source configured to output a drive signal for driving the actuator elements;

a plurality of switching elements connected to the respective actuator elements to separately drive the actuator elements, and configured to selectively apply the output drive signal to the actuator elements; and a plurality of return resistances provided for the respective actuator elements and connected to low potential sides of the actuator elements, each of the return resistances having a resistance value adjusted based on the length of a wiring line between the corresponding one of the actuator elements and the drive signal source, a resistance value of a first return resistance of the return resistances being greater than a resistance value of a second return resistance of the return resistances.

2. The drive circuit for an inkjet recording head according to claim 1, further comprising:

a recording unit configured to store setting information for setting the resistance values of the return resistances, wherein the return resistances are variable resistances, and the resistance values thereof are set in accordance with the setting information stored in the recording unit to cause the resistance value of each of the return resistances to be adjusted in accordance with the length of the wiring line between the corresponding one of the actuator elements and the drive signal source.

3. The drive circuit for an inkjet recording head according to claim 1, wherein each of the switching elements includes an ON resistance having a resistance value adjusted in accordance with the length of a wiring line length between the corresponding one of the actuator elements and the drive signal source.

4. The drive circuit for an inkjet recording head according to claim 1, wherein each of the switching elements comprises a complementary metal oxide semiconductor (CMOS) analog switch.

5. An inkjet recording device comprising:

a drive circuit for an inkjet recording head according to claim 1.

6. The drive circuit for an inkjet recording head according to claim 1, wherein the length of the wiring line between the actuator element corresponding to the first return resistance and the drive signal source being shorter than the length of the wiring line between the actuator element corresponding to the second return resistance and the drive signal source.

* * * * *